US010153554B2

(12) United States Patent
Martinis et al.

(10) Patent No.: US 10,153,554 B2
(45) Date of Patent: Dec. 11, 2018

(54) ELECTRONIC DEVICE ANTENNAS WITH HARMONIC RESONANCES

(71) Applicant: Apple Inc., Cupertino, CA (US)

(72) Inventors: Mario Martinis, Cupertino, CA (US); Carlo Di Nallo, San Carlos, CA (US); Jayesh Nath, Milpitas, CA (US); Yi Jiang, Cupertino, CA (US); Jiangfeng Wu, Santa Clara, CA (US); Lijun Zhang, San Jose, CA (US); Siwen Yong, Santa Clara, CA (US); Mattia Pascolini, San Francisco, CA (US); Zheyu Wang, Sunnyvale, CA (US); Eduardo Jorge Da Costa Bras Lima, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 72 days.

(21) Appl. No.: 15/253,374

(22) Filed: Aug. 31, 2016

(65) Prior Publication Data

US 2018/0062264 A1 Mar. 1, 2018

(51) Int. Cl.

| | |
|---|---|
| ***H01Q 9/04*** | (2006.01) |
| ***H01Q 1/48*** | (2006.01) |
| ***H01Q 1/22*** | (2006.01) |
| ***H01Q 1/50*** | (2006.01) |

(52) U.S. Cl.

CPC ..... *H01Q 9/0421* (2013.01); *H01Q 1/2291* (2013.01); *H01Q 1/48* (2013.01); *H01Q 1/50* (2013.01)

(58) Field of Classification Search

CPC ..... H01Q 1/243

See application file for complete search history.

(56) References Cited

U.S. PATENT DOCUMENTS

| | | | | |
|---|---|---|---|---|
| 6,903,686 | B2 | 6/2005 | Vance et al. | |
| 9,484,631 | B1 | 11/2016 | Napoles et al. | |
| 2014/0253393 | A1 | 9/2014 | Nissinen et al. | |
| 2014/0266922 | A1* | 9/2014 | Jin | H01Q 21/28 343/702 |
| 2015/0296634 | A1* | 10/2015 | Itoh | G02F 1/133308 361/679.01 |
| 2016/0072303 | A1 | 3/2016 | Jeong | |
| 2016/0301138 | A1 | 10/2016 | Hwang et al. | |

* cited by examiner

*Primary Examiner* — Graham Smith

(74) *Attorney, Agent, or Firm* — Treyz Law Group, P.C.; G. Victor Treyz; Tianyi He

(57) ABSTRACT

An electronic device may have a housing and other structures that form an antenna ground for an antenna. An antenna resonating element arm for the antenna may extend along the periphery of the housing. The resonating element arm may have opposing first and second ends. A return path may couple the resonating element arm to the antenna ground at the first end. An antenna feed may be coupled between the resonating element arm and the antenna ground in parallel with the return path. Electrical components such as first and second capacitors may be coupled between the antenna resonating element arm and the antenna ground. A first of the capacitors may be coupled between the antenna resonating element arm and the antenna ground at a location between the first and second ends. A second of the capacitors may be coupled between the second end and the antenna ground.

19 Claims, 8 Drawing Sheets

ELECTRONIC DEVICE ANTENNAS WITH HARMONIC RESONANCES

BACKGROUND

This relates to electronic devices, and more particularly, to antennas for electronic devices with wireless communications circuitry.

Electronic devices are often provided with wireless communications capabilities. To satisfy consumer demand for small form factor wireless devices, manufacturers are continually striving to implement wireless communications circuitry such as antenna components using compact structures. At the same time, there is a desire for wireless devices to cover a growing number of communications bands.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over a range of operating frequencies.

It would therefore be desirable to be able to provide improved wireless communications circuitry for wireless electronic devices.

SUMMARY

An electronic device such as a wristwatch may have a housing with metal portions such as metal sidewalls. The housing and other conductive structures in the device such as metal traces in printed circuits may form an antenna ground for an antenna. An antenna resonating element for the antenna may be formed from a resonating element arm that extends along the periphery of the housing.

The resonating element arm may have opposing first and second ends. A return path may couple the resonating element arm to the antenna ground at the first end. An antenna feed may be coupled between the resonating element arm and the antenna ground in parallel with the return path.

Electrical components such as first and second capacitors may be coupled between the antenna resonating element arm and the antenna ground. A first of the capacitors may be coupled between the antenna resonating element arm and the antenna ground at a location between the first and second ends. A second of the capacitors may be coupled between the second end and the antenna ground The inverted-F antenna may be configured to exhibit a third harmonic resonance at a satellite navigation system band and a fifth harmonic resonance at a wireless local area network band having a higher frequency than the satellite navigation system band.

DETAILED DESCRIPTION

Figure 1:
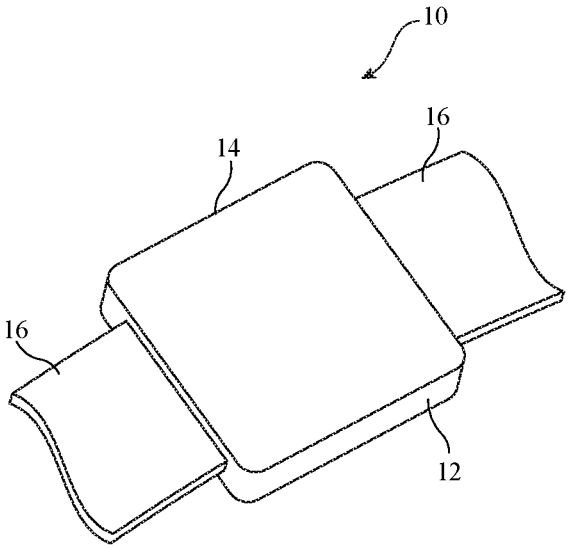
FIG. 1 is a front perspective view of an illustrative electronic device in accordance with an embodiment.

An electronic device such as electronic device 10 of FIG. 1 may be provided with wireless circuitry. The wireless circuitry may include antennas. Antennas such as cellular telephone antennas, wireless local area network antennas, and satellite navigation system antennas may be formed from resonating elements in the electronic device.

Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a wristwatch. Other configurations may be used for device 10 if desired. The example of FIG. 1 is merely illustrative.

Device 10 may have opposing front and rear faces. In the example of FIG. 1, device 10 includes a display such as display 14. Display 14 has been mounted on the front face of device 10 in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Housing 12 may have metal sidewalls or sidewalls formed from other materials. For example, housing 12 may have a metal rear wall that extends over the rear face of device 10.

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures.

Display 14 may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies.

Display 14 may be protected using a display cover layer. The display cover layer may be formed from a transparent material such as glass, plastic, sapphire or other crystalline dielectric materials, ceramic, or other clear dielectric materials.

Device 10 may, if desired, be coupled to a strap such as strap 16. Strap 16 may be used to hold device 10 against a user's wrist (as an example). Configurations that do not include straps may also be used for device 10.

Figure 2:
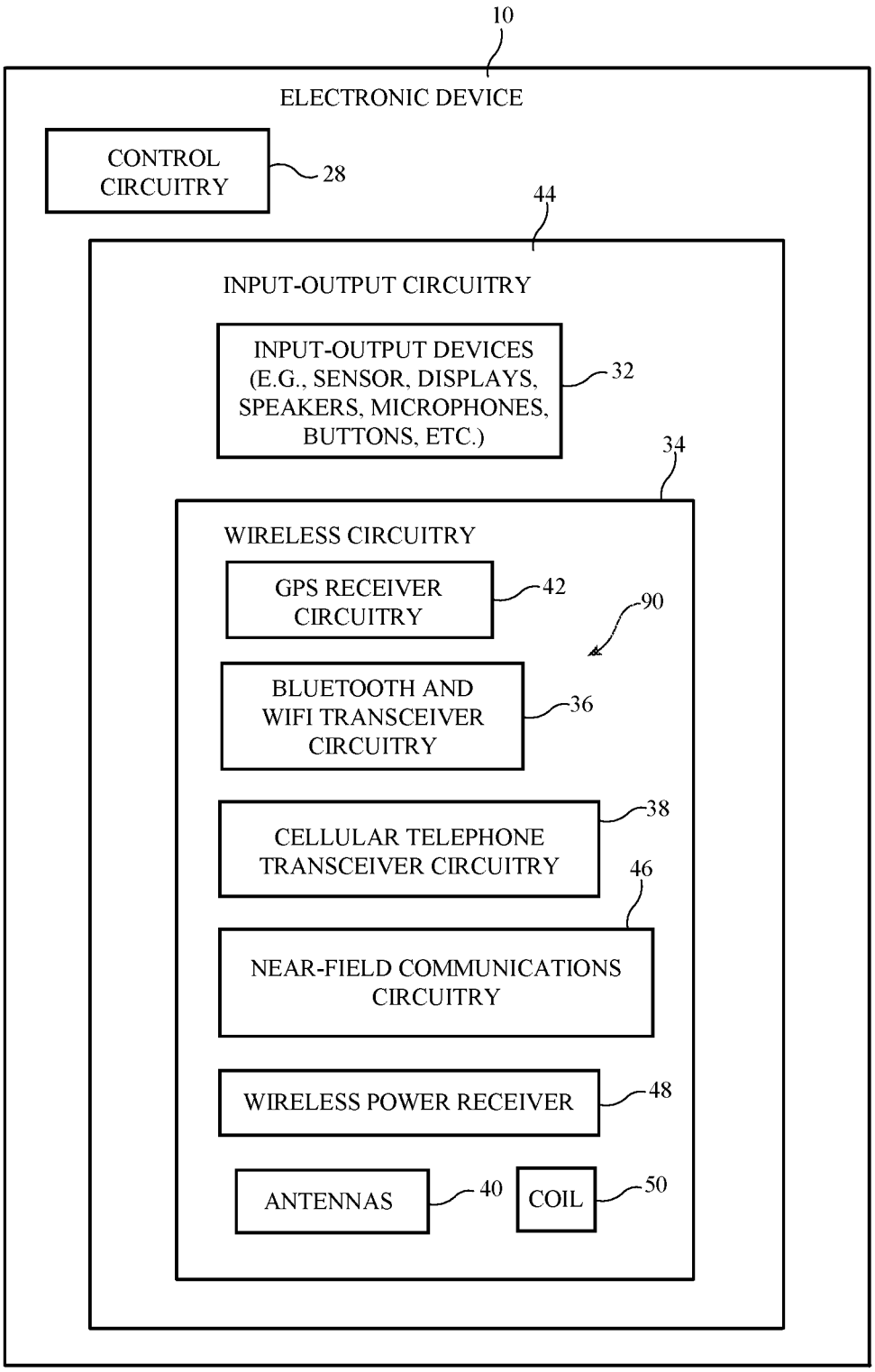
FIG. 2 is a schematic diagram of an illustrative electronic device in accordance with an embodiment.

A schematic diagram showing illustrative components that may be used in device 10 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi® and protocols for other short-range wireless communications links such as the Bluetooth® protocol), cellular telephone protocols, MIMO protocols, antenna diversity protocols, etc.

Input-output circuitry 44 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, scrolling wheels, touch pads, key pads, keyboards, microphones, cameras, buttons, speakers, status indicators, light sources, audio jacks and other audio port components, digital data port devices, light sensors, light-emitting diodes, motion sensors (accelerometers), capacitance sensors, proximity sensors, magnetic sensors, force sensors (e.g., force sensors coupled to a display to detect pressure applied to the display), etc.

Input-output circuitry 44 may include wireless circuitry 34. Wireless circuitry 34 may include coil 50 and wireless power receiver 48 for receiving wirelessly transmitted power from a wireless power adapter. To support wireless communications, wireless circuitry 34 may include radio-frequency (RF) transceiver circuitry formed from one or more integrated circuits, power amplifier circuitry, low-noise input amplifiers, passive RF components, one or more antennas such as antennas 40, transmission lines, and other circuitry for handling RF wireless signals. Wireless signals can also be sent using light (e.g., using infrared communications).

Wireless circuitry 34 may include radio-frequency transceiver circuitry 90 for handling various radio-frequency communications bands. For example, circuitry 34 may include transceiver circuitry 36, 38, 42, and 46. Transceiver circuitry 36 may be wireless local area network transceiver circuitry that may handle 2.4 GHz and 5 GHz bands for WiFi® (IEEE 802.11) communications and that may handle the 2.4 GHz Bluetooth® communications band. Circuitry 34 may use cellular telephone transceiver circuitry 38 for handling wireless communications in frequency ranges such as a low communications band from 700 to 960 MHz, a midband from 1400 MHz or 1500 MHz to 2170 MHz (e.g., a midband with a peak at 1700 MHz), and a high band from 2170 or 2300 to 2700 MHz (e.g., a high band with a peak at 2400 MHz) or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) transceiver circuitry 46 (e.g., an NFC transceiver operating at 13.56 MHz or other suitable frequency), etc. Wireless circuitry 34 may include satellite navigation system circuitry such as global positioning system (GPS) receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, monopole antennas, dipoles, hybrids of these designs, etc. Different types of antennas may be used for different bands and combinations of bands. For example, one type of antenna may be used in forming a local wireless link antenna and another type of antenna may be used in forming a remote wireless link antenna. In some configurations, different antennas may be used in handling different bands for cellular telephone transceiver circuitry 38.

Figure 3:
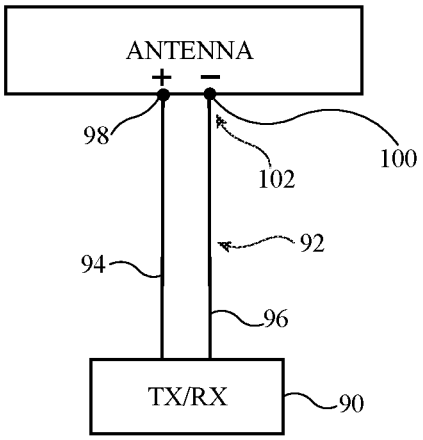
FIG. 3 is a schematic diagram of an illustrative antenna and associated radio-frequency transceiver in accordance with an embodiment.

A schematic diagram showing how antenna 40 may be coupled to transceiver circuitry 90 is shown in FIG. 3. As shown in FIG. 3, radio-frequency transceiver circuitry 90 may be coupled to antenna feed 102 of antenna 40 using transmission line 92. Antenna feed 102 may include a positive antenna feed terminal such as positive antenna feed terminal 98 and may have a ground antenna feed terminal such as ground antenna feed terminal 100. Transmission line 92 may be formed form metal traces on a printed circuit or other conductive structures and may have a positive transmission line signal path such as path 94 that is coupled to terminal 98 and a ground transmission line signal path such as path 96 that is coupled to terminal 100. Transmission line paths such as path 92 may be used to route antenna signals within device 10. For example, transmission line paths may be used to couple antenna structures such as one or more antennas in an array of antennas to transceiver circuitry 90. Transmission lines in device 10 may include coaxial cable paths, microstrip transmission lines, stripline transmission lines, edge-coupled microstrip transmission lines, edge-coupled stripline transmission lines, transmission lines formed from combinations of transmission lines of these types, etc. Filter circuitry, switching circuitry, impedance matching circuitry, and other circuitry may be interposed within transmission line 92 and/or circuits such as these may be incorporated into antenna 40 (e.g., to support antenna tuning, to support operation in desired frequency bands, etc.).

Figure 4:
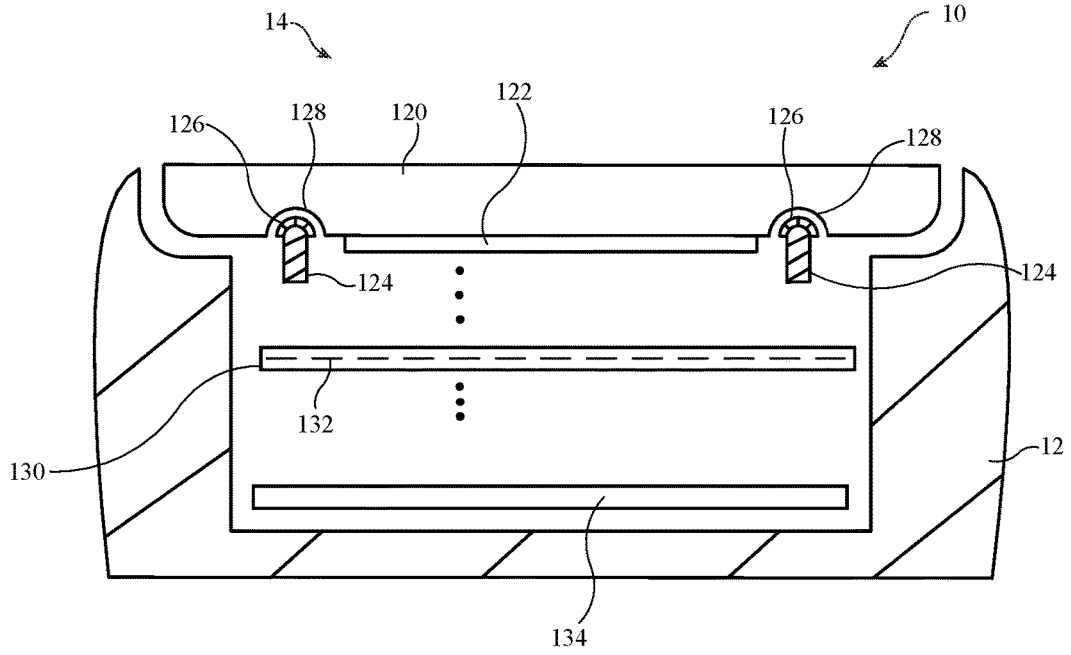
FIG. 4 is a cross-sectional side view of an illustrative electronic device in accordance with an embodiment.

Antenna 40 may be, for example, an inverted-F antenna or other antenna that is formed from a resonating element that runs along the periphery of device 10. Consider, as an example, the illustrative cross-sectional side view of device 10 that is shown in FIG. 4. As shown in FIG. 4, antenna 40 may be formed from metal traces 126 on plastic carrier 124. Plastic carrier 124 may have the shape of a full or partial rectangular ring and may protrude into a rectangular (or partly rectangular) groove such as groove 128 running along the periphery of device 10 in the underside of display cover layer 120.

Display cover layer 120 may be formed from a transparent member that protects display layer 122 and other underlying components from damage. Display cover layer 120 may, for example, be formed from a layer of clear glass, a layer of transparent plastic, a crystalline member such as a sapphire cover layer, or other transparent protective material. Display 14 may include display cover layer 120 and may include a display layer (sometimes referred to as a display or display module) such as display layer 122. Display layer 122 may be a liquid crystal display, an organic light-emitting diode display, an electrophoretic display, or other suitable display and may have one or more layers that form an array of pixels for displaying images to a user. Display layer 122 and/or other layers may be used to form a touch sensor, a near-field communications loop antenna, and/or other components for mounting under display cover layer 120.

Device 10 may also include printed circuits such as printed circuit 130. Printed circuits such as printed circuit 130 may include patterned metal traces for conveying signals between components mounted on the printed circuit and may include ground traces such as illustrative ground trace 132. Traces such as trace 132 and conductive structures in device 10 (e.g., metal housing walls 12), may serve as an antenna ground for antenna 40. Metal traces 126 may serve as an inverted-F antenna resonating element (e.g., an inverted-F arm).

In addition to including components such as display 122 and printed circuit 130, device 10 may include other components 134 mounted in the interior of housing 12. For example, device 10 may include a battery, additional printed circuits, additional integrated circuits, sensors, and/or other circuitry (see, e.g., control circuitry 28 and input-output circuitry 44).

Figure 5:
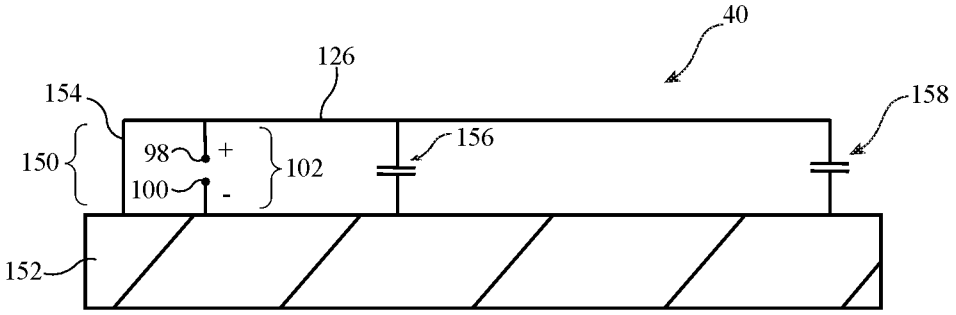
FIG. 5 is a schematic diagram of an illustrative inverted-F antenna in accordance with an embodiment.

FIG. 5 is a schematic diagram of an illustrative antenna of the type that may wrap around some or all of the periphery of device 10. As shown in FIG. 4, antenna 40 may be an inverted-F antenna having inverted-F antenna resonating element 150. Inverted-F antenna resonating element 150 may have antenna resonating element arm 126 (see, e.g., the metal traces 126 on plastic carrier 124 of FIG. 4). Return path 154 (sometimes referred to as a short circuit path) may be coupled between arm 126 and ground 152. Ground 152 may be formed from metal portions of housing 12 (e.g., metal housing sidewalls, a metal rear housing wall, etc.) and/or may be formed from ground traces such as ground traces 132 in printed circuit 130.

Antenna feed 102 may have positive antenna feed terminal 98 coupled to arm 126 and ground antenna feed terminal 100 coupled to antenna ground 152. Feed 102 may be coupled between arm 126 and ground 152 in parallel with return path 154. As shown in the illustrative configuration of FIG. 5, return path 154 may be located on one end of antenna resonating element 150 (e.g., the left-hand side of element 150 in the example of FIG. 5). Adjustable and/or fixed antenna tuning components such as capacitors 156 and 158 may be coupled between antenna resonating element arm 126 and ground 152. For example, capacitor 158 may be coupled between the opposing end of antenna resonating elements 150 and antenna ground 152. Components 156 and 158 are capacitors in the example of FIG. 5, but other types of devices may be incorporated into components 156 and/or 158 if desired (e.g., adjustable inductors, adjustable tuning circuits including both capacitors and inductors, fixed inductors, fixed capacitors, etc.). The value of capacitor 156 may be, for example, 0.1 to 0.5 pF or other suitable values. The value of capacitor 158 may be, for example, 1.0 to 2.0 pF or other suitable values.

Figure 6:
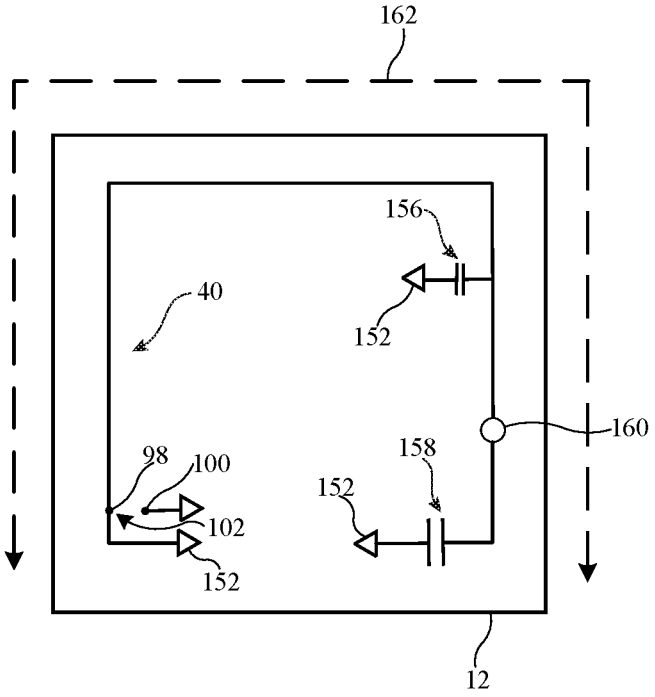
FIG. 6 is a top view of an illustrative electronic device with an antenna in accordance with an embodiment.

Inverted-F antenna resonating element arm 126 may run along the periphery of device 10. For example, inverted-F antenna may run clockwise along three edges of housing 12, as shown in FIG. 6 (e.g., in an illustrative configuration in which housing 12 has a square footprint or other rectangular footprint with four sides). This arrangement for antenna 40 helps antenna 40 exhibit right-hand circular polarization and therefore enhances the ability of antenna 40 to receive circularly polarized signals such as right-hand circularly polarized satellite navigation system signals. Configurations in which arm 126 runs along two sides or four sides of device 10 may also be used. Length 162 of arm 126 may affect the frequency resonances associated with antenna 40. If desired, one or more switches such as optional switch 160 may be included in arm 126 to adjust length 162 of arm 126.

Figure 7:
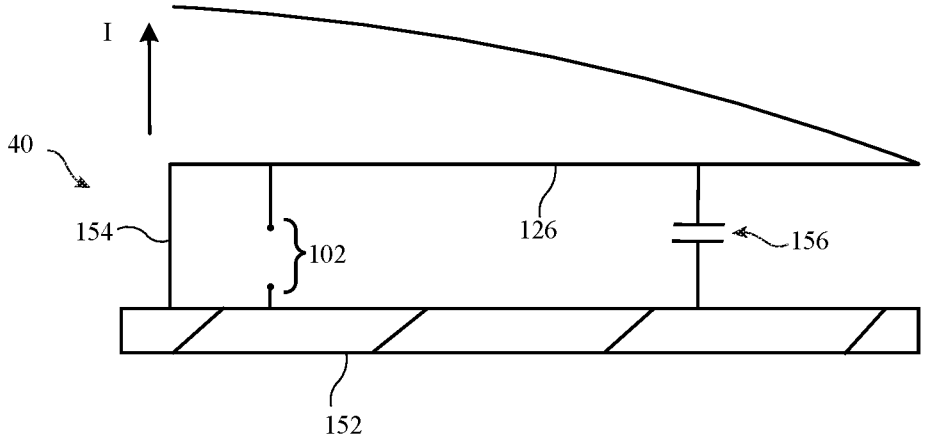
FIGS. 7, 8, and 9 are diagrams showing how an inverted-F antenna resonating element may exhibit a fundamental resonance, a third harmonic resonance, and a fifth harmonic resonance in accordance with an embodiment.
Figure 8:
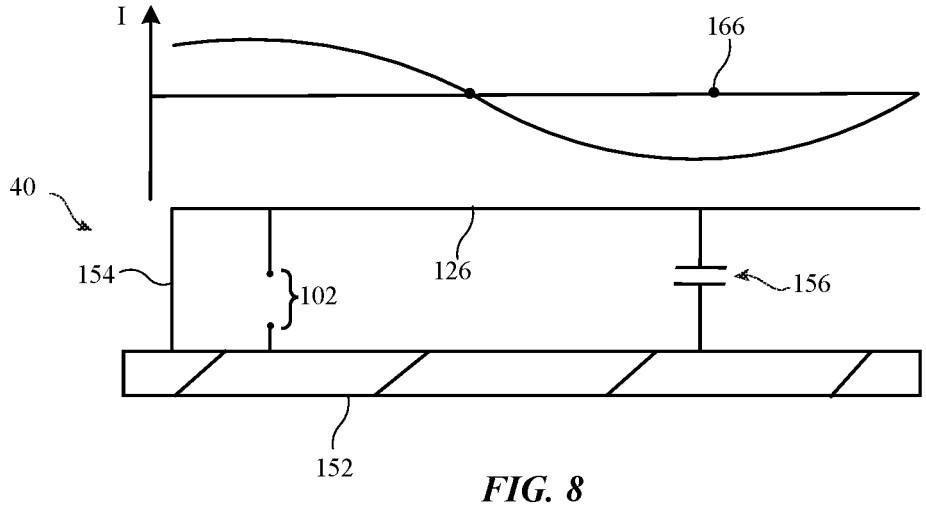
Figure 9:
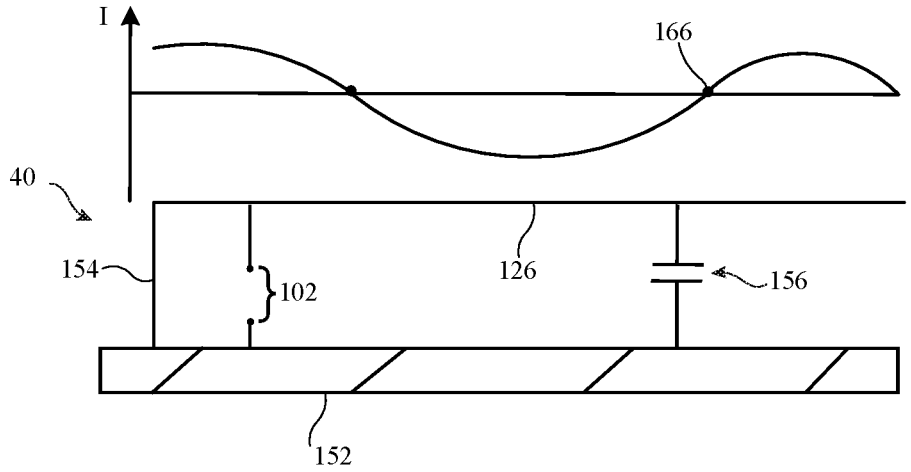

FIGS. 7, 8, and 9 show illustrative frequency resonances that may be associated with antenna 40 of FIG. 6. In each of these FIGS., the distribution of current I in arm 126 has been plotted as a function of position along the length of arm 126. As shown FIGS. 7, 8, and 9, arm 126 may exhibit a fundamental (first order) resonance at frequency 500 MHz (FIG. 7), may exhibit a third order resonance at frequency 1580 MHz (FIG. 8), and may exhibit a fifth order resonance at 2.7 GHz (FIG. 9). Current is a maximum (so that voltage and electric field are a minimum) at point 166 of FIG. 8. Accordingly, capacitor 156 may be located at point 166 so as not to disturb the frequency of the third order resonance. The third order resonance of arm 126 coincides with the Global Positioning System (GPS) frequency of 1575 MHz, so the third order response of arm 126 allows antenna 40 to be used to receive satellite navigation system signals. The fifth order resonance of arm 126 is associated with a current minimum (and therefore a voltage and electric field maximum) at point 166 where capacitor 156 is coupled between arm 126 and ground. Accordingly, the presence of capacitor 156 affects the performance of antenna 40 at the fifth order resonance frequency (about 2.7 GHz in this example). In particular, capacitor 156 reduces the resonant frequency of antenna 40 to about 2.4 GHz (e.g., a frequency associated with wireless local area network signals such as IEEE 802.11 signals and Bluetooth® signal at 2.4 GHz). The ability of capacitor 156 to tune antenna 40 lower at 2.4 GHz while leaving the satellite navigation system frequency band relatively unchanged helps allow the 2.4 GHz and satellite navigation system frequency bands to be independently tuned. Capacitor 158 affects the performance of both of these bands and therefore may help lower the resonant frequency for both satellite navigation system and wireless local area network bands.

Figure 10:
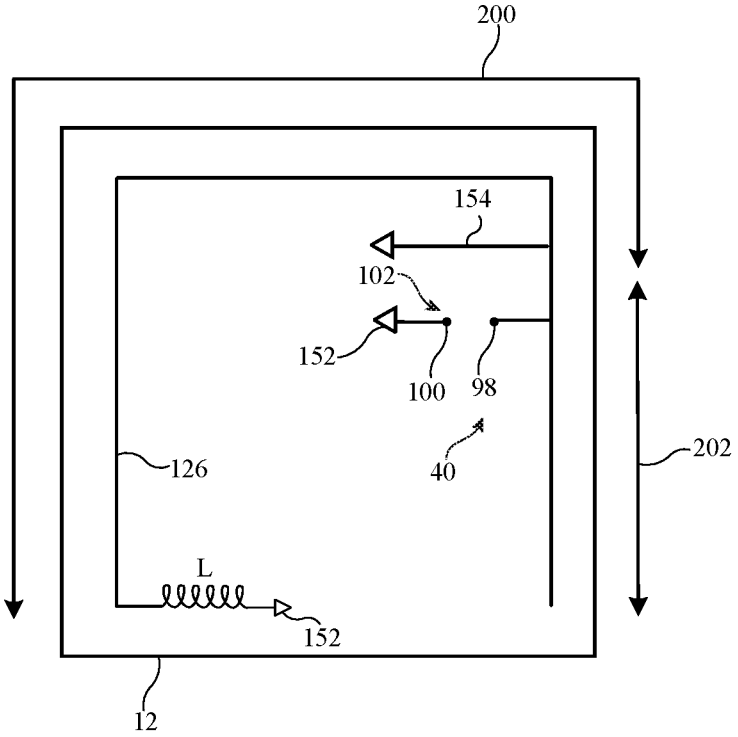
FIGS. 10 and 11 are top views of illustrative electronic devices with antennas in accordance with embodiments.
Figure 11:
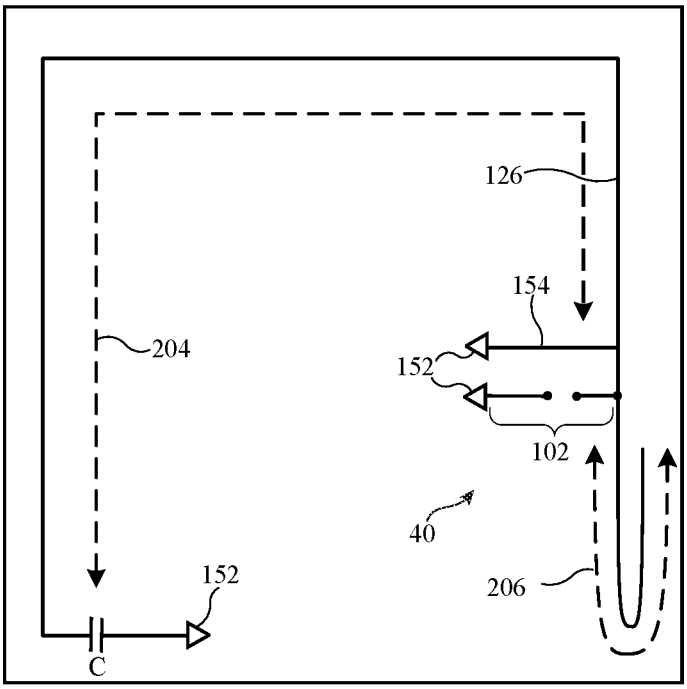

Additional illustrative antenna resonating element arm arrangements for antenna 40 are shown in FIGS. 10 and 11. As with the illustrative configuration of FIG. 6, antennas 40 of FIGS. 10 and 11 may handle both satellite navigation system (e.g., Global Positioning System) and WiFi®/Bluetooth® (e.g., 2.4 GHz wireless local area network) communications bands. In the FIG. 10 configuration, path length 200 may be associated with a second harmonic for antenna 40 that coincides with satellite navigation system frequencies (e.g., 1575 MHz), whereas path length 202 corresponds to a first harmonic for 2.4 GHz (e.g., WiFi®) communications. In the FIG. 11 configuration, path length 204 coincides with a third harmonic at 1575 MHz for satellite navigation system operations and path length 206 of the folded end of arm 126 corresponds to a first harmonic at 2.4 GHz (e.g., for WiFi® communications).

The foregoing is merely illustrative and various modifications can be made to the described embodiments. The foregoing embodiments may be implemented individually or in any combination.

What is claimed is:

1. An electronic device having front and rear faces, comprising:

a housing having a metal housing wall and having a periphery;

a display coupled to the housing on the front face; and an inverted-F antenna including an inverted-F antenna resonating element arm that extends along the periphery and that has first and second opposing ends, an antenna ground formed at least partly from the metal housing wall, a return path that extends between the inverted-F antenna resonating element arm and the antenna ground, an antenna feed coupled between the inverted-F antenna resonating element arm and the antenna ground in parallel with the return path, and an electrical component coupled to the antenna resonating element arm at a location between the first and second ends, wherein the inverted-F antenna is configured to exhibit a third harmonic resonance at a first frequency band and is configured to exhibit a fifth harmonic resonance at a second frequency band having a higher frequency than the first frequency band, and the electrical component is coupled to the inverted-F antenna resonating element arm at a location between the first and second ends at which electric fields are minimized when the inverted-F antenna operates at the first frequency band.

2. The electronic device defined in claim 1 wherein the electrical component comprises a capacitor coupled between antenna resonating element and the antenna ground.

3. The electronic device defined in claim 2 wherein the first frequency band comprises a satellite navigation system band.

4. The electronic device defined in claim 3 wherein the second frequency band comprises a wireless local area network band.

5. The electronic device defined in claim 4 wherein the wireless local area network band comprises a band at 2.4 GHz.

6. The electronic device defined in claim 5 wherein the return path is coupled between the inverted-F antenna resonating element and the antenna ground at the first end.

7. The electronic device defined in claim 1 wherein the metal housing wall has a rectangular outline and the inverted-F antenna resonating element arm extends along three of four sides of the rectangular outline.

8. A wristwatch having front and rear faces, comprising:

a metal housing having metal sidewalls that define a periphery of the metal housing; and an inverted-F antenna including an inverted-F antenna resonating element arm that extends along the periphery, that is surrounded by the metal sidewalls, and that has first and second opposing ends, an antenna ground formed at least partly from the metal housing wall, a return path that extends between the first end of the inverted-F antenna resonating element arm and the antenna ground, and an antenna feed coupled between the inverted-F antenna resonating element arm and the antenna ground in parallel with the return path, wherein the inverted-F antenna is configured to exhibit a third harmonic resonance at a first frequency band and is configured to exhibit a fifth harmonic resonance at a second frequency band having a higher frequency than the first frequency band.

9. The wristwatch defined in claim 8 further comprising a display in the metal housing on the front face.

10. The wristwatch defined in claim 9 wherein the first frequency band comprises a satellite navigation band.

11. The wristwatch defined in claim 10, wherein the display includes a transparent display cover layer having a groove that receives the inverted-F antenna resonating element.

12. The wristwatch defined in claim 10 further comprising a capacitor coupled between the inverted-F antenna resonating element and the antenna ground.

13. The wristwatch defined in claim 12 wherein the capacitor is coupled to the inverted-F antenna resonating element at a location at which electric fields are minimized at the first frequency band and are maximized at the second frequency band.

14. The wristwatch defined in claim 13 further comprising an additional capacitor coupled between the second end and the antenna ground.

15. An electronic device, comprising:

a metal housing having a periphery;

a display in the metal housing having a dielectric display cover layer with a groove that runs along the periphery; and an inverted-F antenna having an inverted-F antenna resonating element arm in the groove that extends along the periphery and that has first and second opposing ends, an antenna ground formed at least partly from the metal housing, a return path that extends between the first end of the inverted-F antenna resonating element arm and the antenna ground, an antenna feed coupled between the inverted-F antenna resonating element arm and the antenna ground in parallel with the return path, and a capacitor coupled between the inverted-F antenna resonating element arm and the antenna ground, wherein the metal housing includes sidewall structures that surround the inverted-F antenna resonating element arm.

16. The electronic device defined in claim 15 wherein the inverted-F antenna is configured to exhibit a third harmonic resonance at a satellite navigation system band and is configured to exhibit a fifth harmonic resonance at a wireless local area network band having a higher frequency than the satellite navigation system band.

17. The electronic device defined in claim 16 wherein the capacitor is coupled to the inverted-F antenna resonating element at a location between the first and second ends at which electric fields are minimized when the inverted-antenna resonating element operates at the satellite navigation system band.

18. The electronic device defined in claim 16 wherein the capacitor is coupled to the inverted-F antenna resonating element at a location between the first and second ends at which electric fields are maximized when the inverted-antenna resonating element operates at the satellite navigation system band.

19. The electronic device defined in claim 16 wherein the metal housing has four sides and wherein the inverted-F antenna resonating element extends along three of the four sides of the metal housing.

* * * * *